US009943897B2

(12) United States Patent
Abbasi

(10) Patent No.: US 9,943,897 B2
(45) Date of Patent: Apr. 17, 2018

(54) PRESS BENDING OF PIPES

(71) Applicant: Hamid Reza Abbasi, Isfahan (IR)

(72) Inventor: Hamid Reza Abbasi, Isfahan (IR)

( * ) Notice: Subject to any disclaimer, the term of this patent is extended or adjusted under 35 U.S.C. 154(b) by 0 days.

(21) Appl. No.: 15/130,175

(22) Filed: Apr. 15, 2016

(65) Prior Publication Data

US 2017/0297075 A1 Oct. 19, 2017

(51) Int. Cl.

| | |
|---|---|
| ***B21D 9/01*** | (2006.01) |
| ***B21D 9/12*** | (2006.01) |
| ***B21D 9/16*** | (2006.01) |

(52) U.S. Cl.

CPC ..... *B21D 9/01* (2013.01); *B21D 9/12* (2013.01); *B21D 9/16* (2013.01)

(58) Field of Classification Search

CPC ... B21D 9/01; B21D 9/03; B21D 9/12; B21D 9/125; B21D 9/15; B21D 9/16

See application file for complete search history.

(56) References Cited

U.S. PATENT DOCUMENTS

| | | | | |
|---|---|---|---|---|
| 2,984,284 | A | 5/1961 | Ballard | |
| 4,412,442 | A | 11/1983 | Kawanami et al. | |
| 5,564,303 | A * | 10/1996 | Buchanan | B21D 11/00 72/466 |
| 5,765,285 | A | 6/1998 | Buy et al. | |
| 2004/0256095 | A1 * | 12/2004 | Yogo | B21D 9/073 166/55 |

FOREIGN PATENT DOCUMENTS

| | | | | |
|---|---|---|---|---|
| FR | 1274784 | A * | 10/1961 | B21D 9/03 |
| WO | 2014087328 | A1 | 6/2014 | |

* cited by examiner

*Primary Examiner* — Debra Sullivan
(74) *Attorney, Agent, or Firm* — NovoTechIP International PLLC

(57) ABSTRACT

A pipe bending system for pressure bending a pipe is disclosed. The pipe bending system includes a pipe having a first end and a second end; a housing including a bending configuration and configured to house the pipe; a flexible material placed within an interior space of the pipe; and a pressing device configured to press the flexible material housed inside the interior space of the pipe. The pressing device includes a first arm, a second arm, and a controller. The flexible material includes a plurality of pieces each having a different elasticity type.

14 Claims, 3 Drawing Sheets

PRESS BENDING OF PIPES

TECHNICAL FIELD

The present application relates generally to pipe bending techniques and, more particularly, to a pipe bending device and method for bending thin-wall pipes with a critical bend radius using press bending methods.

BACKGROUND

Various industries such as land and air transportation vehicle manufacturers need strong and at the same time light weight components such as, for example, pipes. Thin-wall pipes made from alloys of aluminum, titanium, rust resistant steel, etc., are widely used in such industries and are bent with various radiuses and bending angels. In order to reduce weight on the one hand, and volume on the other hand, these pipes are typically formed with minimum bend radius. As a result, due to the specific characteristics of light and thin-walled pipes, conventional bending methods cannot be used for bending such pipes with high bending radiuses (e.g., when bending radius is equivalent of the pipe outside diameter), because bending such pipes using the conventional methods may cause changes in the thickness of the pipe wall, occurrence of tears or wrinkles in the pipe wall, or deformation or upsetting of the pipe. Therefore, a need exists for a device and method for bending thin-wall pipes to prevent damages such as deformation or upsetting, change in the pipe wall thickness and tears or wrinkles to the pipe body.

SUMMARY

In one general aspect, the instant application describes a pipe bending system for pressure bending a pipe. The pipe bending system includes a pipe having a first end and a second end; a housing including a bending configuration and configured to house the pipe; a flexible material placed within an interior space of the pipe; and a pressing device configured to press the flexible material housed inside the interior space of the pipe. The pressing device includes a first arm, a second arm, and a controller. The flexible material includes a plurality of pieces each having a different elasticity type. The first arm is configured to engage the first end of the pipe and move the pipe toward the bending configuration within the housing. The second arm is configured to engage the flexible material at the second end of the pipe. The controller is coupled to the second arm and configured to: (i) maintain the second arm in stationary position until a threshold pressure is applied to the flexible material, thereby causing the flexible material to expand in a direction of a diameter of the pipe and (ii) once the threshold pressure is reached, enable the second arm to retract as the first arm moves the pipe toward the bending configuration within the housing.

The above-general aspect may include one or more of the following features. For example, the housing may include a molding compartment. The flexible material may include an elastomer filler. The elastomer filler may include a plurality of elastomer pieces laid out inside the pipe such that: (i) one or more of the elastomer pieces stuffed at the first end and at the second end of the pipe have a hard type elasticity, (ii) one or more of the elastomer pieces stuffed in middle of the pipe have a soft type elasticity, and (iii) one or more of the elastomer pieces stuffed between the one or more of the elastomer pieces having hard type elasticity and the one or more of the elastomer pieces having soft type elasticity have a medium type elasticity with a hardness between the hard type elasticity and the soft type elasticity.

The diameter of an elastomer piece from the plurality of elastomer pieces may be smaller than a diameter of inside of the pipe such that a clearance gap may be formed between a pipe wall and the elastomer filler. The value of clearance gap may be different for each of the one or more of the elastomer pieces having the hard type elasticity, the one or more of the elastomer pieces having the soft type elasticity, and the one or more of the elastomer pieces having the medium type elasticity. The clearance gap for the one or more of the elastomer pieces having the hard type elasticity may be from 1.5 to 2 millimeters. The clearance gap for the one or more of the elastomer pieces having the soft type elasticity may be smaller than 0.5 millimeter. The clearance gap for the one or more of the elastomer pieces having the medium type elasticity may be from 0.5 to 1 millimeters.

A total length of the elastomer filler may be larger than a length of the pipe such that a portion of the elastomer filler protrudes outwardly from the first end or the second end of the pipe. The length of the protrusion portion may be between 3 and 4 millimeters. The pipe bending system may further include a wire threading configured to thread together the plurality of elastomer pieces through an opening at center of each elastomer piece, such that the elastomer pieces are removed from the pipe by pulling the wire. The threading wire may be connected to a thin metal disk on one of the first end or the second end of the pipe. The diameter of the metal disk may be smaller than the diameter of the elastomer piece adjacent to the metal disk. The threading wire may be loose on an opposite end of the pipe.

The diameter of the opening may be 2 millimeters and a diameter of the threading wire may be smaller than the diameter of the opening. A fireproof grease may be applied between adjacent elastomer pieces from the plurality of elastomer pieces. The fireproof grease may be applied on external surfaces of the elastomer pieces adjacent to inner wall of the pipe. The elastomer piece may include a disk shape. The diameter of the elastomer piece may be a diameter of the disk, and corners of the disk may be curved. The thickness of the disk may be between 20 and 30 millimeters. The radius of the curved corners may be 1 millimeter. The disk shaped elastomer piece may be a convex disk.

The pipe may be a thin-wall 6061 aluminum alloy pipe. The first arm may include a hydraulic ram jack. The second arm may include a metal mandrel. The metal mandrel may be a spherical mandrel.

In another general aspect, the instant application describes a method for pressure bending a pipe. The method includes placing an elastomer filler inside the pipe, wherein the elastomer filler includes a plurality of elastomer pieces, the plurality of elastomer pieces having different elastic properties; placing the pipe including the elastomer filler inside a bending mold; pressing a first end of the pipe toward a bending location within the bending mold by using a ram jack; pressing the elastomer filler inside the pipe from a second end of the pipe using a metal mandrel and a mandrel controller ram connected to the metal mandrel; and bending the pipe at the bending location within the bending mold while the elastomer filler is pressed within the pipe.

The above general method aspect may include one or more of the following features. For example, the plurality of elastomer pieces may be laid out inside the pipe such that: (i) one or more of the elastomer pieces stuffed at the first end and at the second end of the pipe have a hard type elasticity, (ii) one or more of the elastomer pieces stuffed in middle of the pipe have a soft type elasticity, and (iii) one or more of the elastomer pieces stuffed between the one or more of the elastomer pieces having hard type elasticity and the one or more of the elastomer pieces having soft type elasticity have a medium type elasticity with a hardness between the hard type elasticity and the soft type elasticity.

The diameter of an elastomer piece from the plurality of elastomer pieces may be smaller than a diameter of inside of the pipe such that a clearance gap is formed between a pipe wall and the elastomer filler. The value of clearance gap may be different for each of the one or more of the elastomer pieces having the hard type elasticity, the one or more of the elastomer pieces having the soft type elasticity, and the one or more of the elastomer pieces having the medium type elasticity.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Figure 1:
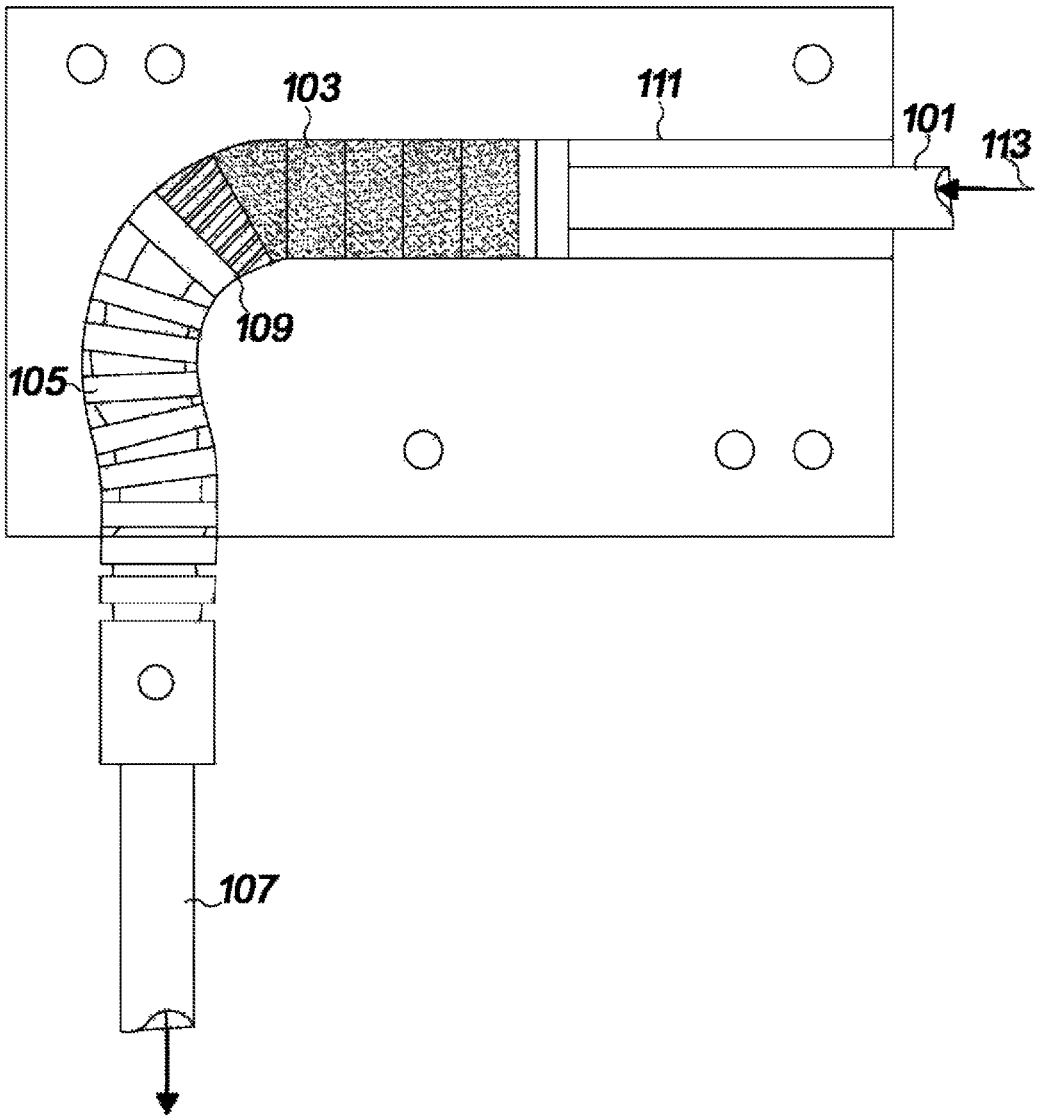
FIG. 1 illustrates a pipe bending device, according to an implementation.

FIG. 1 illustrates a pipe bending device, according to an implementation. Prior to bending a pipe 109, the pipe 109 can be filled with a flexible material 103. The flexible material 103 can be made from elastomers filler such as, for example, rubber, polyurethane, etc. Upon filling the pipe 109 with flexible material 103, the pipe 109 can be placed inside a mold 111. The mold 111 may include a bending configuration designed to receive the pipe 109 and bend the pipe 109 to take the form of the bending configuration within the mold 111.

Once the pipe 109 is fixed inside the mold 111, the pipe 103 may be pressed toward the bending configuration within the mold 111 by a hydraulic ram jack 101 in the direction shown by arrow 113. The hydraulic ram jack 101 may be configured to come into contact with the first end of the pipe 109 and push the first end of the pipe 109 toward the bending configuration within the mold 111. The hydraulic ram jack 101 may have a spherical shape and a diameter slightly larger than the diameter of the pipe 109. The hydraulic ram jack 101 may also include a rubber ball at its end with a diameter about substantially the same size as the pipe 109. The rubber ball may be configured to seal the first end of the pipe 109 to keep the elastomer filler 103 from coming out of the first end as the pipe 109 is pressed toward the being configuration within the mold 111.

In one implementation, slightly before the bending configuration (e.g., between the bending configuration in the mold 111 and the first end of the pipe), a metal mandrel 105 may be placed and may be held at this position with a holding element. The holding element may include a hydraulic pump. The hydraulic pump may be connected to a mandrel control ram 107 configured to control the movement of the metal mandrel 105. In one example, the mandrel control ram 107 may control the metal mandrel 105 to maintain its position until the applied pressure to the elastomer filler 103 reaches a certain threshold. Once the applied pressure to the elastomer filler 103 reaches the certain threshold, the controller may control the metal mandrel 105 to maintain this pressure while moving toward the molding configuration within the mold 111 as the pipe 109 is pressed toward the molding configuration by the hydraulic ramp jack 101.

In one implementation, the total length of the elastomer filler 103 may be less than the length of the pipe 109. In this implementation, the metal mandrel 105 may have a spherical shape and a diameter smaller than the diameter of the pipe 109. The metal mandrel 105 may be configured to be received within the pipe 109 as the pipe 109 moves toward the bending configuration within the mold 111. In this manner, as the pipe 109 moves toward the bending configuration within the mold 111 by the hydraulic ramp jack 101, the elastomer filler 104 is pressed within the pipe 109 since its movement is stopped by the metal mandrel 105. This may cause the elastomer filler 103 to be pressed in the direction of the pipe 109 axis, thereby causing the elastomer filler 103 to expand or inflate in the direction of pipe 109 diameter. This expansion can produce pressure towards the walls of the pipe 109. The pressure produced by the pressed elastomer filler 103 perpendicular to the walls of the pipe 109 may prevent undesired deformation of the pipe due to bending. This pressure may also prevent wrinkling and thinning of the pipe 109 wall due to bending. While the elastomer filler 103 is pressed by the hydraulic ram jack 101 on the first end and the metal mandrel 105 on the second end, the pipe 109 can be guided toward the bending configuration by the hydraulic ram jack 101. The pipe 109 is bent in accordance with the bending configuration within the mold 111. The elastomer filler 103 may also take the bent shape of the pipe 109.

In another implementation, the total length of the elastomer filler 103 may be slightly longer than the length of pipe 109 and therefore a piece of elastomer filler 103 may protrude out from the pipe 109. During the bending process, the elastomer filler 103 may behave like a fluid and may be pushed at both ends to be pressed within the pipe 109. In one implementation, the elastomer filler 103 may be pressed such that in the pressed condition each end of the elastomer filler 103 is fully encapsulated within the pipe 109. In another implementation, the elastomer filler 103 may be pressed such that in the pressed condition each end of elastomer filler 103 may still extend out of the pipe 109. In yet another implementation, the elastomer filler 103 may be pressed such that in the pressed condition one end of the elastomer filler 103 is fully encapsulated within the pipe 109 and another end of the elastomer filler 103 extends outside of the pipe 109 in the pressed condition.

The metal mandrel 105 may be connected to a mandrel control ram 107. The mandrel control ram 107 can maintain a constant pressure applied on the elastomer filler 103 during the bending process. In one implementation, once the pressure applied to the elastomer filler 103 reaches a certain threshold, the mandrel control ram 107 instructs the mandrel metal 105 to move back as the pipe 103 is pressed toward the bending configuration within the mold 111 to maintain the constant threshold pressure applied to the elastomer filler 103. In this manner, the pipe 109 along with the compressed elastomer filler 103 enter the bending configuration space within the mold 111 and bend within the mold 111.

The elasticity features of the elastomer filler 103 provide flexibility to the elastomer fillers such that when the fillers are taken out of the pipe 109 the elastomers can regain their initial shape and can be reused in further bending processes. The elastomer filler 103 can be made from a combination of multiple layers of various elastomers with different features such as hardness, elasticity, etc. It is noted that the types of elastomer layers used in the elastomer filler 103 and the arrangement of the layers can affect the quality of bend and the effect the bending may have on the pipe shape and the pipe wall thickness. In one implementation, hard and flexible elastomers, for example black Polyvinyl chloride (PVC) can be used on the ends of the elastomer filler 103. The black PVC on one end of the elastomer filler 103 can be in contact with the hydraulic ram jack 101 on one end of the pipe 109 and the black PVC on the other end of the elastomer filler 103 can be in contact with the metal mandrel 105. The elastomer filler 103 in the middle of the pipe can be selected from a soft elastomer such as, for example, yellow polyurethane. The mid-layer of elastomers position between the hard layers and the soft layer can be selected from elastomers with medium hardness to transfer the pressure force from the hard layer to the soft layer. If the mid-layer elastomer is made from hard elastomer, it may cause deformation of the pipe wall due to pressure and if the mid-layer elastomer is made from soft elastomers, it may not be capable of transferring the pressure force from an end of the pipe 109 to the soft middle layer and this may cause wrinkling in the middle of the pipe 109 at the time of bending. Therefore, the type of the elastomer used as filler in different parts of the pipe 109 may be an important factor in pressure bending. The mid-layer elastomer fillers can be selected from red polyurethane with medium hardness in the midway between a hard elastomer and a soft elastomer.

As previously discussed, pipe 109 may be manufactured from various materials such as, for example, alloys of aluminum, titanium, rust resistant steel, etc. In one implementation, bending of a thin-wall 6061 aluminum alloy pipe 109 is disclosed. The bend factor F (e.g., diameter of the bend) of a pipe 109 with outside diameter $D_{out}$ when the pipe 109 is bent with a bend centerline radius R can be calculated using equation (1):

$$F=R/_{Dout} \quad (1)$$

For example, the disclosed method and device can be used for bending the thin-wall 6061 aluminum alloy pipe 109 in critical conditions (e.g., with a critical bend radius where a ratio of central radius to the outside diameter of the pipe is between 1 and 2) wherein the bend factor F is between 1 and 2 ($1 \leq F \leq 2$).

Figure 2:
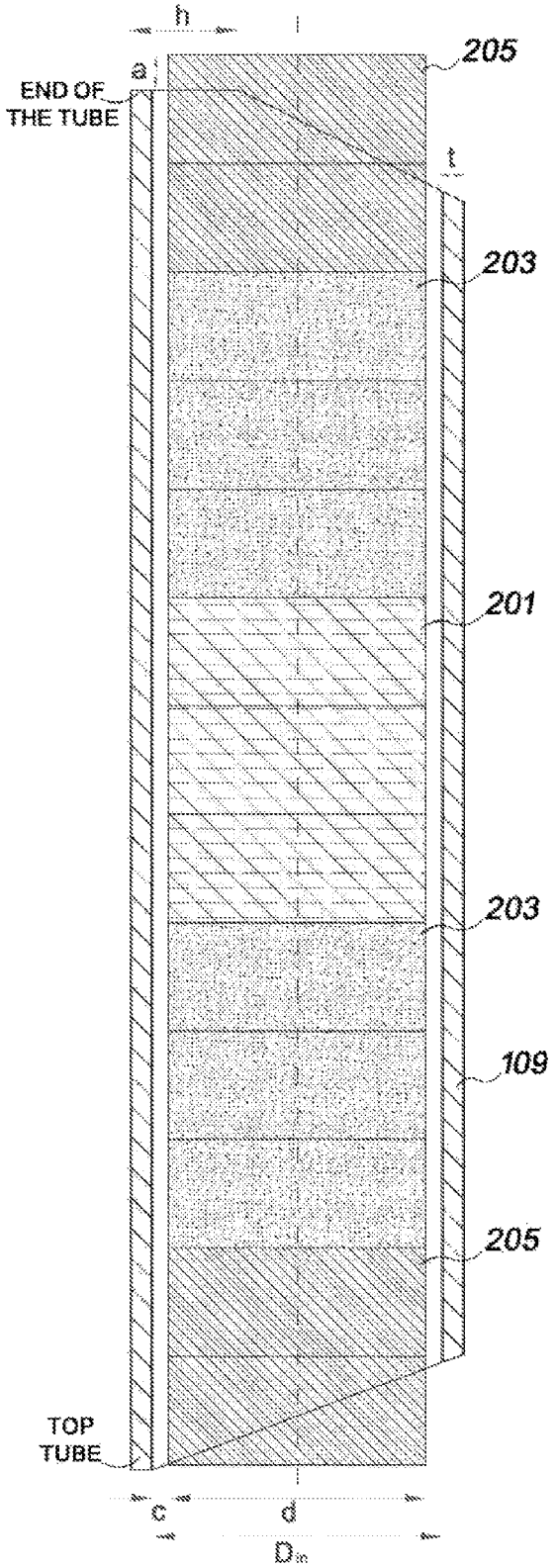
FIG. 2 illustrates arrangement of elastomer filler pieces in a pipe being bent, according to an implementation.

FIG. 2 illustrates arrangement of elastomer filler pieces in a pipe being bent, according to an embodiment. In FIG. 2, a pipe 109 with a wall thickness t and inside diameter $D_{in}$. The elastomer filler pieces 201, 203, and 205 are used to fill the pipe 109 and prepare the pipe for bending. As previously discussed, the elastomer pieces 205 on the ends of pipe 109 are the hard type elastomer, elastomer pieces 201 are soft type elastomer in the middle of the pipe 109 and elastomer pieces 203 are mid-layer elastomers with a medium hardness between hard elastomers 205 and soft elastomers 201. Multiple pieces of each elastomer type can be used, where each piece may have a disk-shape with a thickness shown as b. Each piece of elastomer may have a diameter d which can be slightly smaller than inside diameter $D_{in}$ of pipe 109, such that a clearance gap c is created between the elastomers and the pipe wall. A total length of the elastomer fillers may be slightly longer than the length of pipe 109 and therefore a piece of elastomer shown as $\alpha$ may protrude out from the pipe 109. During the bending process, the soft elastomer 201 may behave like a fluid and flow towards the ends. However, the hard elastomers 205 prevent the soft elastomer 201 to extrude out of the pipe 109. The elastomers 203 transfer the pressure from hard elastomers 205 to soft elastomers 201. Table 1 shows and example of elastomer types that can be used for stuffing the pipe 109.

TABLE 1

| Elastomer type | Elastomer color | Material |
|---|---|---|
| Hard | Black | PVC |
| Medium | Red | Vinyl Chloride |
| Soft | Yellow | Polysulphide |

Vinyl Chloride, used as a medium type elastomer 203, is a resin with high elastic memory. This resin may have a hardness between 55 and 80 on a Shore D hardness scale. The modulus of elasticity of the medium type elastomer can be between 15,000 and 25,000 per square inch (psi). Depending on the skill level of an operator performing the pipe bending, this type of medium elastomer can be reused in 200 to 400 cycles of pipe bending process.

The soft elastomer 201 may have high compressibility property. The soft elastomer 201 may be made from natural rubber, synthetic rubber or poly sulphide rubber. The poly sulphide rubber may have a variable hardness between 5 and 85 on a Shore A hardness scale. The modulus of elasticity of poly sulphide may be 0.0025 times the modulus elasticity of the medium elastomer. This elastomer may be reused in about 1000 to 2000 cycles of pipe bending process. However, if the medium type elastomer is used throughout the pipe, the elastomer life may be limited to 3 to 10 bending cycles. In addition, it is noted that the modulus elasticity of the medium type elastomer may be a function of the ratio of the diameter to the thickness of the elastomer. The lower the ratio is, the higher the modulus elasticity of the medium type rubber may be. Each piece of elastomer may be resistant to the repeated attrition during the bending cycles. Therefore, sponge type elastomers may not be a suitable elastomer for this purpose because the sponge elastomers tend to tear during the bending process due to uneven attrition forces in different parts of the elastomer. Therefore, porous elastomer types may not be suitable as pipe fillers during pipe bending processes.

The hard elastomer at both ends of the pipe may be under direct pressure from the hydraulic ram jack 101 on one end and the mandrel controller ram 107 on the other end of pipe 109. The hard elastomers may be made from PVC.

The number of pieces of elastomers 201, 203, and 205 can be different depending on the length of pipe 109. The multi piece elastomers may have a longer life compared to a one piece elastomer and can be used repeatedly for extended lengths of time.

The clearance gap c between the elastomers and the pipe wall can be determined based on the elastomer types. In fact, the value of clearance gap c can be different for each elastomer type, hard, soft and medium. In the case of hard and medium type elastomers 203 and 205, if the value of clearance gap c is too small, the pressure from hydraulic ram jack 101 and mandrel controller ram 107 may not be transferred to the soft elastomer 201 in the middle. This may cause wrinkling of the pipe wall at the bend location. On the other hand, if the value of clearance gap c is too large, the soft elastomer may not expand or buckle due to the pressure and instead the soft elastomer may tend to extrude and flow out from the pipe. In this case, too, the pipe may be wrinkled because the pressure cannot be transferred to the bend location.

In the case of soft elastomers 201, if the value of clearance gap c is too low, the pressure transfer may be desirable, however, upon completion of the bending process, removing the elastomer from the pipe may be very difficult. However, a too high clearance gap c may cause the pressure force to be spent on expanding the diameter of the soft elastomer and the pressure is not transferred to the pipe wall and this may cause wrinkling of the pipe wall. Table 2 shows the optimum ranges of the clearance gap c for each elastomer type.

TABLE 2

| Elastomer type | Elastomer color | Optimum clearance gap (c) between the pipe wall and the elastomer filler (millimeters) |
|---|---|---|
| Hard | Black | $1.5 \le c \le 2$ |
| Medium | Red | $0.5 \le c \le 1$ |
| Soft | Yellow | $c < 0.5$ |

Experimental results show that the total length of the elastomer fillers 201, 203, and 205 need to be slightly longer than the length of pipe 109 such that the hard elastomer 205 protrudes out from pipe 109. The protruding portion of hard elastomer 205 from pipe 109 is shown in FIG. 2 as $\alpha$. The reason for protruding length a is that elastomers typically retract under pressure and may retract inward inside the pipe 105 for up to 20 millimeters on each side. If the protrusion value $\alpha$ is too large, the hard elastomer 205 may buckle and give way under pressure, however, if the protrusion value $\alpha$ is too small, the elastomer feeling may retract to the point that a pressure from the hydraulic ram jack 101 cannot reach the elastomer filler. In addition, retraction of the elastomer fillers inside the pipe can make removal of the fillers from the pipe at the end of bending process difficult. The experimental results show that the optimal value for the protrusion value $\alpha$ can be between 3 and 4 millimeters.

As previously discussed and shown in FIG. 2, the elastomer filler may consist of individual disk-shaped elastomers laid out inside the pipe 109. In cases when a wrinkling occurs on the pipe wall during the bending process, removing the individual pieces of elastomer from the pipe may become problematic. In order to prevent such problems, a small opening can be created in the center of each disk-shaped elastomer. A thin wire with a diameter slightly smaller than the opening can run through the openings of the disk-shaped elastomers and thread the elastomers together. A thin metal disk with a diameter smaller than the diameter of elastomers can be placed next to the last elastomer 205 on one end of the pipe 109 and one end of the wire can be tied to the metal disks. The other end of the wire can be left untied. Upon completion of the bending process, the elastomer fillers can be removed from the pipe by pulling the untied end of the wire. The diameter of the opening on the disk-shaped elastomer can be about 2 millimeters and the diameter of the wire can be slightly less than the diameter of the opening.

The threading of the elastomer fillers, as discussed, prevents the elastomers from being trapped inside the bent pipe 109. In addition, the treaded elastomer fillers can be used repeatedly for other bending processes for pipes similar to pipe 109 without a need for the fillers to be repeated laid out inside the pipe one by one.

When the elastomers fillers are being laid out next to each other, a layer of fireproof oil or grease can be applied on the touching surfaces of the consecutive disk-shaped elastomer fillers. The grease can create adhesion between the elastomer fillers. The outer surface of the elastomer fillers touching the internal wall of pipe 109 can also be greased. If no grease is applied, a high friction may be generated between the elastomers and the pipe wall and the friction may reduce the pressure inside the pipe. The reduced pressure may affect the bending process by causing wrinkles in the pipe wall.

The degree of roughness of the surface of each elastomer filler can affect the bending process. According to the experiments performed, the optimum value of the $R_\alpha$ factor (e.g., the arithmetic average of absolute values of collected roughness data points) may be from 0.5 to 0.6. ($0.5 \le R_\alpha \le 0.6$).

Figure 3B:
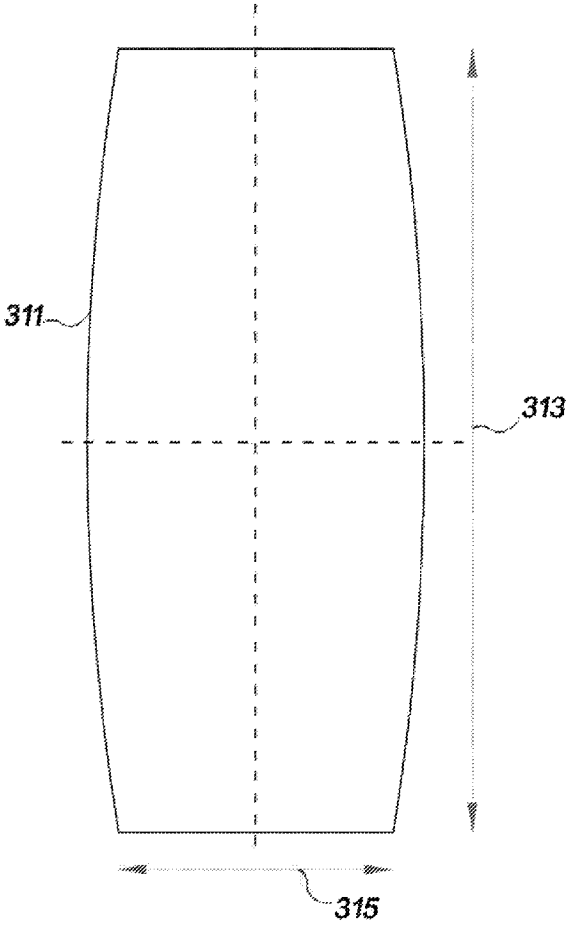
FIGS. 3A-3B illustrate shape of elastomer fillers, according to an implementation.
Figure 3A:
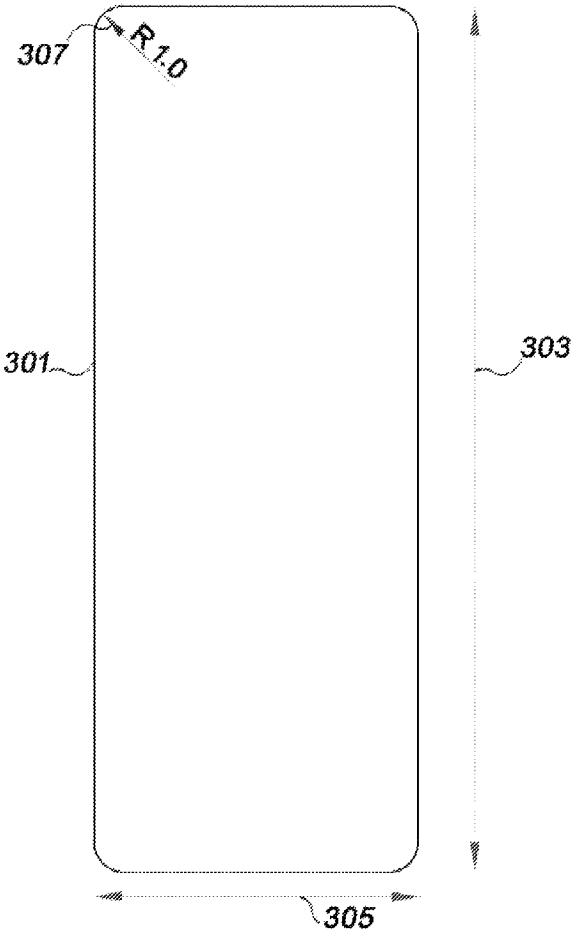

FIGS. 3A-3B illustrate the shape of elastomer fillers. According to an embodiment. In FIG. 3A, the diameter of elastomer 301 is shown as 303. Elastomer 301 is similar to elastomers 201, 203, and 205 of FIG. 2. The diameter 303 is determined based on the inside diameter or pipe 109 and also based on the value of the clearance gap c previously discussed. Item 305 in FIG. 3A shows the width of an elastomer filler. The width 305 can typically be between 20 and 25 millimeters. In order to prevent stress concentration on the corners of elastomer filler 301 and also prevent the elastomer from cracking the corners can be curved shown as 307, for example with a radius of 1 millimeter. The experimental results suggest that convex shaped elastomers with curved sides as shown in FIG. 3B may produce better pipe bending results compared to straight lined elastomers as shown in FIG. 3A. The convex shape of elastomer 311 can cause a homogeneous expansion or inflation of the elastomer due to pressure. As a result, upon removal of the pressure at the end of bending process, contact between the elastomer and the pipe wall may be reduced and this can make removal of the elastomer from the pipe easier.

The separation of various components in the examples described above should not be understood as requiring such separation in all examples, and it should be understood that the described components and systems can generally be integrated together in a single packaged into multiple systems.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus the following claims are hereby incorporated into the Detailed Description, with each claim standing on its own as a separately claimed subject matter.

What is claimed is:

1. A pipe bending system for pressure bending a pipe, the pipe pending system comprising:

a pipe having a first end and a second end;

a housing including a bending configuration and configured to house the pipe;

a flexible material placed within an interior space of the pipe; and a pressing device configured to press the flexible material housed inside the interior space of the pipe, the pressing device including a first arm, a second arm, and a controller, wherein:

the first arm is configured to engage the first end of the pipe and move the pipe toward the bending configuration within the housing, the second arm is configured to engage the flexible material at the second end of the pipe, and the controller is coupled to the second arm and configured to: (i) maintain the second arm in stationary position until a threshold pressure is applied to the flexible material, thereby causing the flexible material to expand in a direction of a diameter of the pipe and (ii) once the threshold pressure is reached, enable the second arm to retract as the first arm moves the pipe toward the bending configuration within the housing, wherein the housing includes a molding compartment, the flexible material includes an elastomer filler, and the elastomer filler includes a plurality of elastomer pieces laid out inside the pipe such that: (i) the elastomer pieces stuffed at the first end and at the second end of the pipe have a hard type elasticity, (ii) one or more of the elastomer pieces stuffed in middle of the pipe have a soft type elasticity, and (iii) one or more of the elastomer pieces stuffed between the one or more of the elastomer pieces having hard type elasticity and the one or more of the elastomer pieces having soft type elasticity have a medium type elasticity with a hardness between the hard type elasticity and the soft type elasticity, the pipe bending system further comprising:

a wire threading configured to thread together the plurality of elastomer pieces through an opening at a center of each elastomer piece, such that the elastomer pieces are removed from the pipe by pulling the wire; and a fireproof grease applied between adjacent elastomer pieces from the plurality of elastomer pieces, wherein the fireproof grease is applied on external surfaces of the elastomer pieces adjacent to inner wall of the pipe.

2. The pipe bending system of claim 1, wherein diameters of the plurality of elastomer pieces are smaller than an inside diameter of the pipe such that a clearance gap is formed between a pipe wall and the elastomer filler.

3. The pipe bending system of claim 2, wherein the value of clearance gap is different for each of the elastomer pieces having the hard type elasticity, the elastomer pieces having the soft type elasticity, and the elastomer pieces having the medium type elasticity.

4. The pipe bending system of claim 3, wherein:

the clearance gap for the one or more of the elastomer pieces having the hard type elasticity is from 1.5 to 2 millimeters, the clearance gap for the one or more of the elastomer pieces having the soft type elasticity is smaller than 0.5 millimeter, and the clearance gap for the one or more of the elastomer pieces having the medium type elasticity is from 0.5 to 1 millimeters.

5. The pipe bending system of claim 2, wherein:

each of the plurality the elastomer pieces includes a disk shape, and the diameter of each of the plurality the elastomer pieces is a diameter of a disk, and corners of the disk are curved.

6. The pipe bending system of claim 5, wherein:

a thickness of the disk is between 20 and 30 millimeters, and a radius of the curved corners is 1 millimeter.

7. The pipe bending system of claim 5, wherein the disk shaped elastomer piece is a convex disk.

8. The pipe bending system of claim 1, wherein a total length of the elastomer filler is larger than a length of the pipe such that a portion of the elastomer filler protrudes outwardly from the first end or the second end of the pipe.

9. The pipe bending system of claim 8, wherein a length of the protrusion portion is between 3 and 4 millimeters.

10. The pipe bending system of claim 1, wherein:

the threading wire is connected to a thin metal disk on one of the first end or the second end of the pipe, a diameter of the metal disk is smaller than the diameter of the elastomer piece adjacent to the metal disk, and the threading wire is loose on an opposite end of the pipe.

11. The pipe bending system of claim 1, wherein a diameter of the opening is 2 millimeters and a diameter of the threading wire is smaller than the diameter of the opening.

12. The pipe bending system of claim 1, wherein the pipe is a thin-wall 6061aluminum alloy pipe.

13. The pipe bending system of claim 1, wherein:

the first arm includes a hydraulic ram jack, and the second arm includes a metal mandrel.

14. The pipe bending system of claim 13, wherein the metal mandrel is a spherical mandrel.

* * * * *